US006039597A

United States Patent [19]

Getselis et al.

[11] Patent Number: 6,039,597

[45] Date of Patent: Mar. 21, 2000

[54] LAMPHOLDER FOR COMPACT FLUORESCENT LAMPS

[75] Inventors: Arkady Getselis, Staten Island; Walter Newman, Bayside; Anthony Tufano, North Massapequa, all of N.Y.

[73] Assignee: Leviton Manufacturing Co., Inc., Little Neck, N.Y.

[21] Appl. No.: 09/088,476

[22] Filed: Jun. 1, 1998

Related U.S. Application Data

[62] Division of application No. 08/687,864, Jul. 26, 1996, Pat. No. 5,758,952.

[51] Int. Cl.[7] ..... H01R 4/24

[52] U.S. Cl. ..... 439/441; 439/439

[58] Field of Search ..... 439/441, 438, 439/439, 440, 436, 437

[56] References Cited

U.S. PATENT DOCUMENTS

| | | | |
|---|---|---|---|
| D. 307,001 | 4/1990 | Zuklie | D13/134 |
| 2,720,634 | 10/1955 | Hart | 439/441 |
| 3,093,433 | 6/1963 | Ege | 439/441 |
| 3,979,615 | 9/1976 | Neff | 439/441 |
| 4,133,595 | 1/1979 | Pritulsky | 439/441 |
| 4,723,200 | 2/1988 | Troen | 362/260 |
| 4,785,384 | 11/1988 | Zwald et al. | 302/255 |
| 4,971,567 | 11/1990 | Mizuno et al. | 439/441 |
| 5,189,339 | 2/1993 | Peshak | 315/58 |
| 5,245,518 | 9/1993 | Aspenwall | 362/226 |
| 5,381,322 | 1/1995 | Humphreys | 362/220 |
| 5,494,456 | 2/1996 | Kozel et al. | 439/441 |
| 5,685,735 | 11/1997 | Hohorst | 439/441 |

*Primary Examiner*—Paula Bradley
*Assistant Examiner*—Tho Dac Ta
*Attorney, Agent, or Firm*—Paul J. Sutton

[57] ABSTRACT

A lamp housing to support and power a compact dual or quad-tube fluorescent lamp. A body portion with a central cavity receives the lamp base and selectively retains same using a trapped metal clip; contacts mounted in separated cavities receive the lamp leads at a first end and at the second end the bared end of an electrical conductor inserted into a one way type clutch contact lever to apply AC power to the lampleads. The contact lever can be bifurcated to independently engage more than a single conductor. The lamphousing can be mounted to a panel using fasteners extending through apertures in mounting pads of the base, or by using flexible mounting tabs to grip the underside of a mounting panel or a combination of the flexible mounting tabs and flexible arms to permit the lampholder to be mounted on panels of different thicknesses.

8 Claims, 10 Drawing Sheets

LAMPHOLDER FOR COMPACT FLUORESCENT LAMPS

This application is a division of application Ser. No. 08/687,864 filed on Jul. 26, 1996, now U.S. Pat. No. 5,758,952.

BACKGROUND OF THE INVENTION

1. Field of the Invention

The invention relates to a combined socket and support for a fluorescent lamp and more particularly to a combined socket and mounting support for compact fluorescent lamps.

2. Description of the Prior Art

Widely used fluorescent lamps are generally straight and have two pins at each end for engagement with a socket. To be able to wire up both sets of pins, conductors had to be routed along the reflector, either in front or in back of such reflector. The advent of the U-shaped fluorescent lamp simplified the wiring to some degree since both sets of pins were at the same end of the lamp. These U-shaped lamps, although shorter for a given light output were more than twice as wide as an equivalent straight tube which limited its usefulness. Compact fluorescent lamps were developed which use two parallel tubes joined at one end and having at their opposite ends a single pin or lead. This type of lamp is called a twin tube fluorescent lamp which may be obtained from the Twin Tube Lamp Center, 24500 Solon Road, Bedford Heights, Ohio 44116. Because only one pin or lead is required at each end of the lamp and because both pins are adjacent one another the wiring of such lamps is quite simple. However, since the lamps themselves must be supported and positioned in, for example, a lamphold, the provision of a compact socket and support device is required.

Some prior art lamps are fitted to a screw-in base similar to a standard light bulb base which can be screwed into a usual mogul base socket. Where the socket is supported on a panel or a reflector, an additional support is required making the assembly quite large.

SUMMARY OF THE INVENTION

The present invention seeks to overcome all of the above noted short comings of the prior art by providing a small, simple, easily used device which can be mounted to a mounting panel, to a reflector or similar device and which provides a support for the compact fluorescent lamp with a releasable latch to hold the lamp in place and electrical contacts to provide the AC power to the lamp to light it.

A central cavity in the base contains a snap clip which will engage the lamp base and hold it in position and combined with the base will support the lamp. Contact cavities are fitted adjacent the base central cavity and contain contacts which are wired to AC power lines and which engage the lamp pins or leads to cause the lamp to light.

The contacts have tabs that engage holes in the base walls to prevent the contacts removal after same have been installed. Two facing contact fingers engage the lamp pin placed between such fingers. At the back end of the contact are two cantilevered members bent inwardly toward the contact fingers. The bared ends of conductors, one for each member, are pushed between the lever free ends and an adjacent portion of the contact. The members act as one-way clutches which permit the conductors to be inserted between the member end and the adjacent portion of the contact but prevents it from being withdrawn. By providing multiple conductor engagement points at each contact, the contacts can be daisy-chained or otherwise wired without additional connectors.

In a quad-tube device, two or four contacts are provided to engage the two or four pins, depending on the type of lamp used. Only one snap clip is required for engaging the quad-tube base.

A pair of flexible latch members depend from the base and each has an outwardly tapered first end which ends in an undercut portion. The latch members deflect inwardly when pushed through a suitable aperture in a mounting panel and return to their original positions when the undercut portions are adjacent the bottom surface of the panel. The flexible latch members may be flanked by flexible arms ending in hemispherical protuberances. These arms will flex to accommodate a wide range of panel thickness between the protuberances and the undercut of the latch members. Four apertures are provided at the base corners to receive fasteners to mount the lampholder on a panel. It is an object of the present invention to provide a novel lampholder for compact fluorescent lamps.

It is another object of the present invention to provide a novel lampholder for twintube compact fluorescent lamps.

It is still another object of the present invention to provide a novel lampholder for quad-tube compact fluorescent lamps.

It is an object of the present invention to provide a novel lampholder for compact fluorescent lamps which can be mounted within an aperture in a panel or atop the panel.

It is a further object of the present invention to provide a novel lampholder for compact fluorescent lamps having a snap clip which can selectively retain a compact fluorescent lamp therein.

It is another object of the present invention to provide a novel lampholder for compact fluorescent lamps which employs a contact which can independently terminate one or more conductors.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWING

In the drawings in which similar elements are given similar reference characters.

DESCRIPTION OF THE PREFERRED EMBODIMENTS

Figure 1:
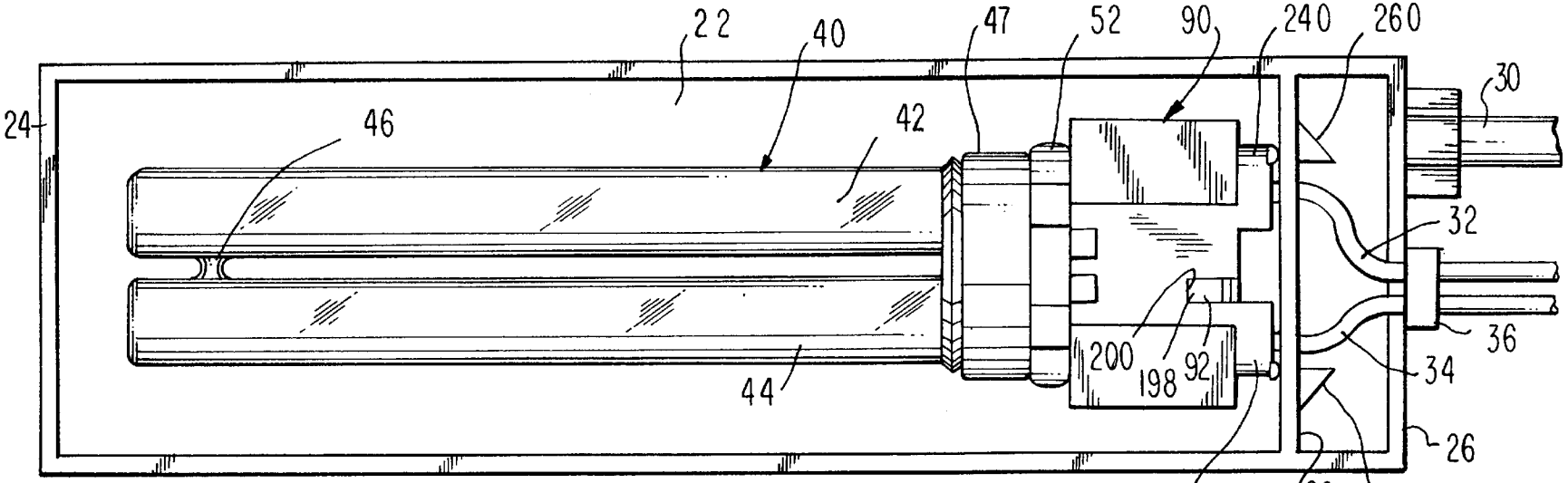
FIG. 1 is a bottom plan view of a lighting fixture employing a lampholder for compact fluorescent lamps constructed in accordance with the concepts of the invention.

Turning now to FIG. 1 there is shown a lamp 20 having a reflector 22 and end walls 24 and 26. A mounting panel 28 extends across the width of reflector 22 parallel with end walls 24 and 26. A lampholder 90 is mounted to mounting panel 28 by means of arms 260 and 270 which extend through an aperture (not shown) in mounting panel 28 and engage the rear surface of mounting panel 28 about the aperture. Lamp support 30 is coupled to end wall 26 and extends to a base or clamp (not shown). Conductors 32, 34 extend from a plug (not shown) through a strain relief 36 to lampholder 90. Plugged into lampholder 90 is a twin tube fluorescent lamp 40 having two parallel tubes 42, 44 joined as at 46. Joint 46 permits the gas in the tubes 42 and 44 to intermix and allows for current to pass between the tube leads through the gas in tubes 42 and 44.

Figure 4:
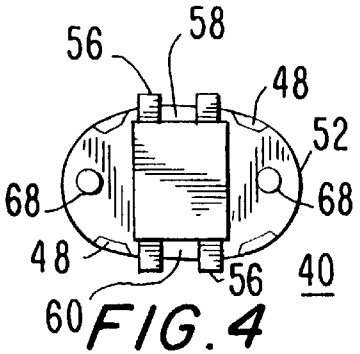
FIG. 4 is a rear elevational view of the twin tube of FIG. 3.
Figure 2:
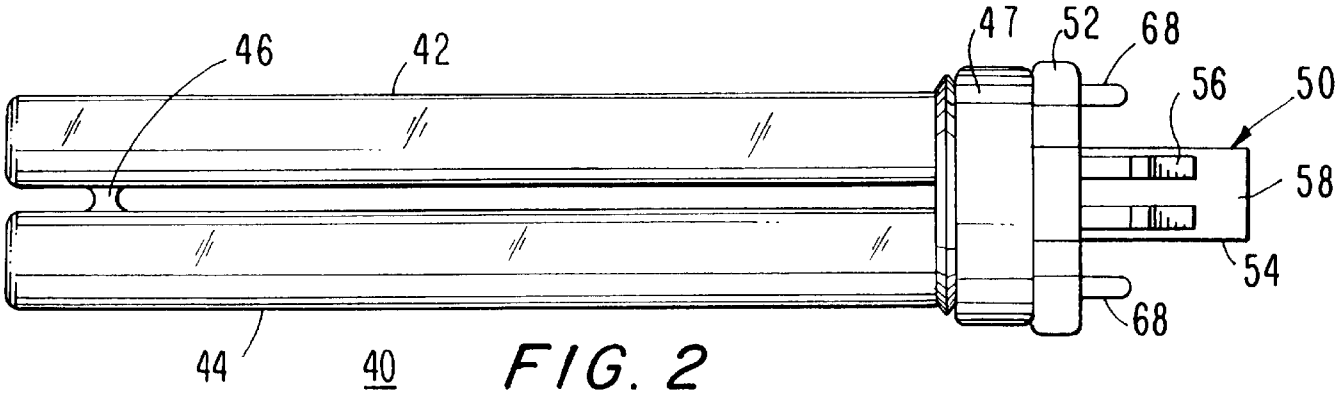
FIG. 2 is a top plan view of a twin tube of the type sold by Twin Tube Lamp Center as identified above.
Figure 3:
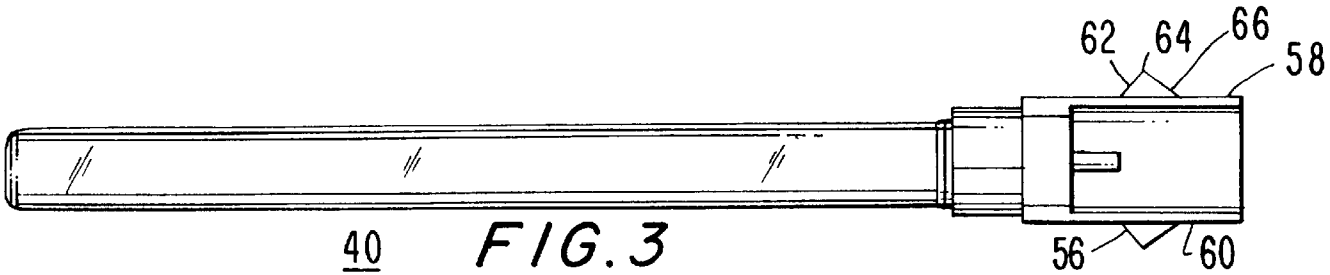
FIG. 3 is a side elevational view of the twin tube of FIG. 2.

As shown in FIGS. 2, 3 and 4 twin tube fluorescent lamp 40 has a base 50 having a generally oval ring 52 of plastic, rubber, ceramic or other insulating material held in place by a metal band 47 crimped to the ring 52 of base 50 at positions such as 48 shown in FIG. 4. The remainder of base 50 is a rectangular portion 54 upon which a pair of raised ribs 56 appear on top side 58 and bottom side 60. As is best seen in FIG. 3, raised ribs 56 have an upwardly inclined leading surface 62 and a downwardly inclined trailing surface 66 joined to surface 62 at high point 64. The raised ribs 56 will be used, as will be described below, to engage the snap clip and retain the twin tube fluorescent lamp 40 in the lampholder 90. Extending through ring 52 are leads or pins 68, one for each of said tubes 42 and 44.

Figure 16:
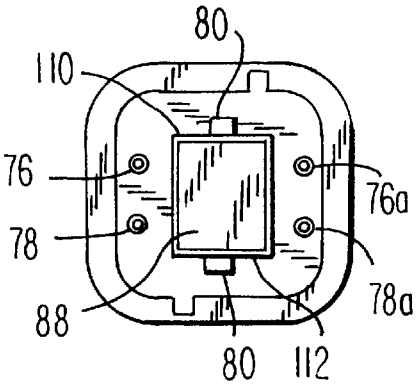
FIG. 16 is a rear elevational view of the quad-tube of FIG. 5.
Figure 5:
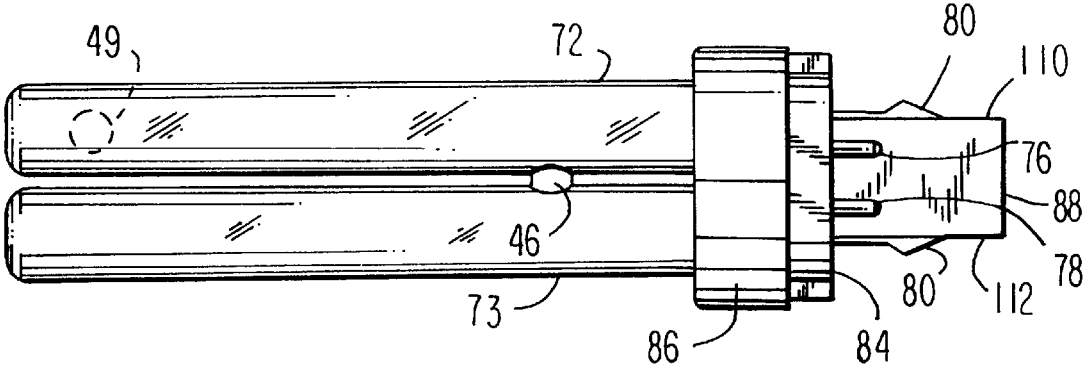
FIG. 5 is a top plan view of a quad-tube as sold by the Twin Tube Lamp Center.

FIGS. 5 and 16 show a quad-tube fluorescent lamp 70 which is made up of four tubes. Tube 73 and tube 72, positioned side-by-side, are interconnected as at 46, adjacent their free ends in the same manner as tubes 42 and 44. Tube 72*a* and tube 73*a*, below tubes 72 and 73 and not visible in the figures, are similarly joined as at 46 (not shown). In addition, tube 72 and tube 72*a* are interconnected at 49 (shown in phantom line) so that all four tubes are connected in series. Base 86, of insulating material, has a generally rectangular band 84 held in place by a metal or plastic band 84 joined to base 86. The remainder of base 86 is a rectangular portion 88 upon which are placed two raised ribs 80 on top side 110 and further raised ribs 80 on the bottom side 112, both raised ribs 80 extending for a portion of the length of then respective surfaces 110, 112. The ribs 80 are contoured in the same manner as ribs 56 of FIG. 3. The pins 76 and 78 for tubes 72, 73, respectively, shown in solid line in FIG. 16, are stacked one atop the other and generally separated by rectangular portion 88. If four pins are required by the quad-tube fluorescent lamp 70 because it does not contain an internal starter or the quad-tube lamp 70 is to be used with a dimmer device four pins are required. Ribs 80 engage a snap clip (not shown) to lock quad-tube fluorescent lamp 70 in the lampholder 300 to be discussed below with reference to FIG. 15.

Figure 12:
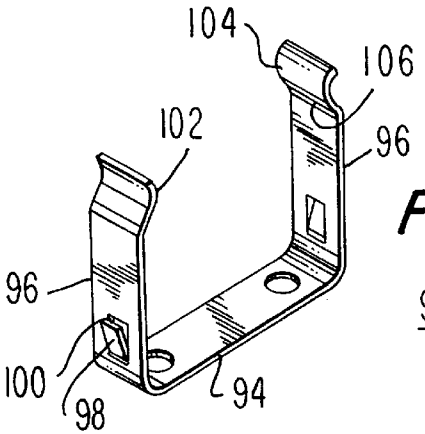
FIG. 12 is a perspective view of the snap clip of the lampholder of FIG. 6.

Turning to FIG. 12 there is shown a snap clip 92 made of a resilient metal such as stainless steel having a base 94 with two upstanding arms 96 which together generally describe a U. Each of the upstanding arms 96 is lanced to provide a tab 98 whose free end 100 will engage with the lampholder body as will be described below to prevent unwanted removal of the clip 92 from the lampholder 90. Adjacent the free ends of each of the arms 96, there is placed an inwardly curved section 102 having a leading section 104. Curved sections 102 expand the spacing between arms 96 as they ride over trailing surfaces 66 of raised ribs 56. Curved sections 102 each end with a trailing section 106 which engages the leading surfaces 62 of raised ribs 56 to lock the twin tube fluorescent lamp 40 to the lampholder 90, while the curved sections 102 will engage the surfaces of rectangular portion 54 in front of the leading surfaces 62 of the raised ribs 56. Withdrawing lamp 40 from lampholder 90 causes the trailing sections 106, and then curved sections 102, to ride over leading surfaces 62 to expand the spacing between arms 96 to permit full withdrawal of the lamp 40.

Figure 13:
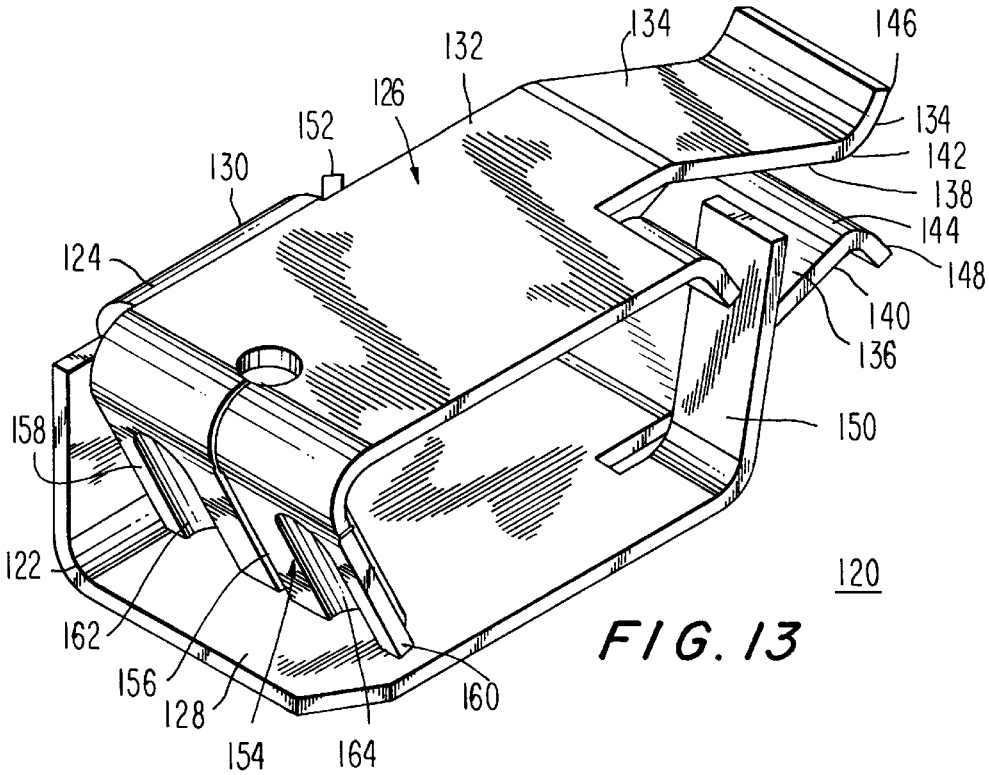
FIG. 13 is a rear perspective view of a contact of the lampholder of FIG. 6.
Figure 14:
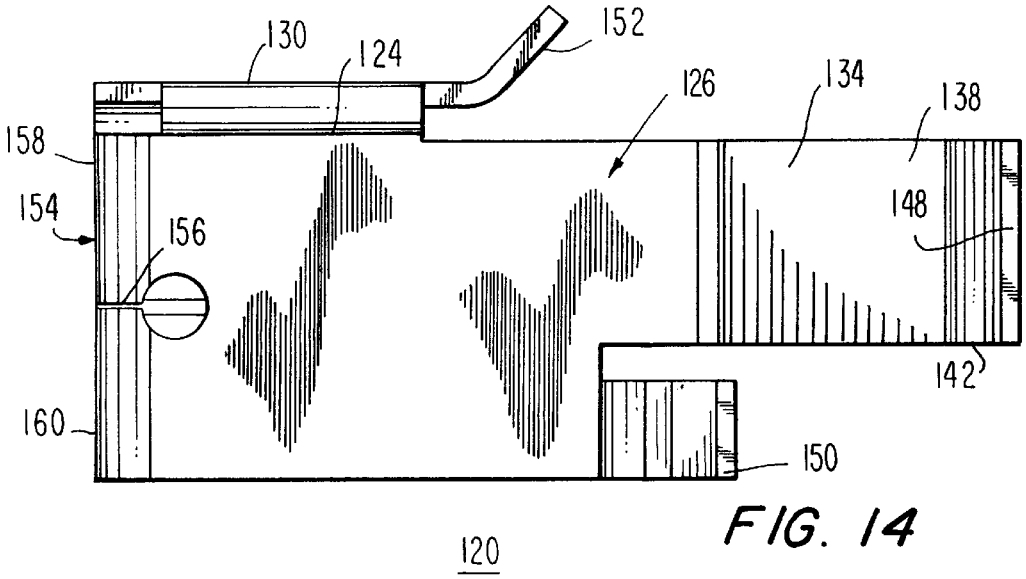
FIG. 14 is a top plan view of the contact of FIG. 13.

Referring now to FIGS. 13 and 14, the details of the contact 120 are set forth. Contact 120 is made of a resilient, conductive metal such as an alloy of copper and, for example, may be beryllium copper. The contact 120 is made of a single blank of metal folded as a edges 124 and 122 to make a three sided box-like connector body 126 having a base 128, a side 130 perpendicular to base 128 and a top 132 perpendicular to side 130. Base 128 and top 132 each have portions of reduced width, 134 and 136, respectively, the free ends of which are formed with inwardly directed sections 138 and 140 which extend towards the longitudinal axis of contact 120. Sections 138 and 140 are followed by curved sections 142 and 144, respectively, and terminate in outwardly directed, with respect to the longitudinal axis, sections 146, 148. When lead or pin 68 engages the leadin sections 146, 148, the portions 134 and 136 separate until the lead or pin 68 comes to rest between curved sections 142, 144 which make up the lead end of contact 120.

Tab 150, formed when base 128 is cut to provide portion 136, is bent at an acute angle with respect to the plane of base 128 and acts as a spacer in the contact cavity to be discussed below and to limit possible compression of the contact 120. An outwardly directed tab 152 is formed at a free end of side 130. The tab 152 will engage a slot in a wall of the housing cavity to prevent contact 120 being removed from such housing.

At the second, free end, of top 132 is a tab 154 bent at an acute angle to the plane of top 132. Tab 154 is divided into two separately operable tabs 158 and 160 by slot 156. The tabs 158 and 160 are strengthened and made more rigid by the ribs 162 and 164 formed in tabs 158 and 160, respectively. The tabs 158 and 160, which make up the conductor end, operate as one-way clutches. When the bared end of a conductor (not shown) is placed on base 128 and advanced towards, for example, tab 158, the tab 158 will pivot inwardly towards tab 150 until the bared conductor is able to pass between the free end of tab 158 and base 128. The electrical connection is established between the contact base 128 and tab 158. Any attempt to pull the conductor out of the contact 120 causes the tab 158 to try to rotate in a clockwise direction which jams the free end of tab 158 into the bared portion of the inserted conductor and both the tab 158 and conductor against base 128. This action prevents the removal of the terminated conductor. The availability of two tabs 158 and 160 means that two conductors can be terminated at each contact 120 making daisy chains or more complex wiring possible right at the contact 120 itself.

Figure 6:
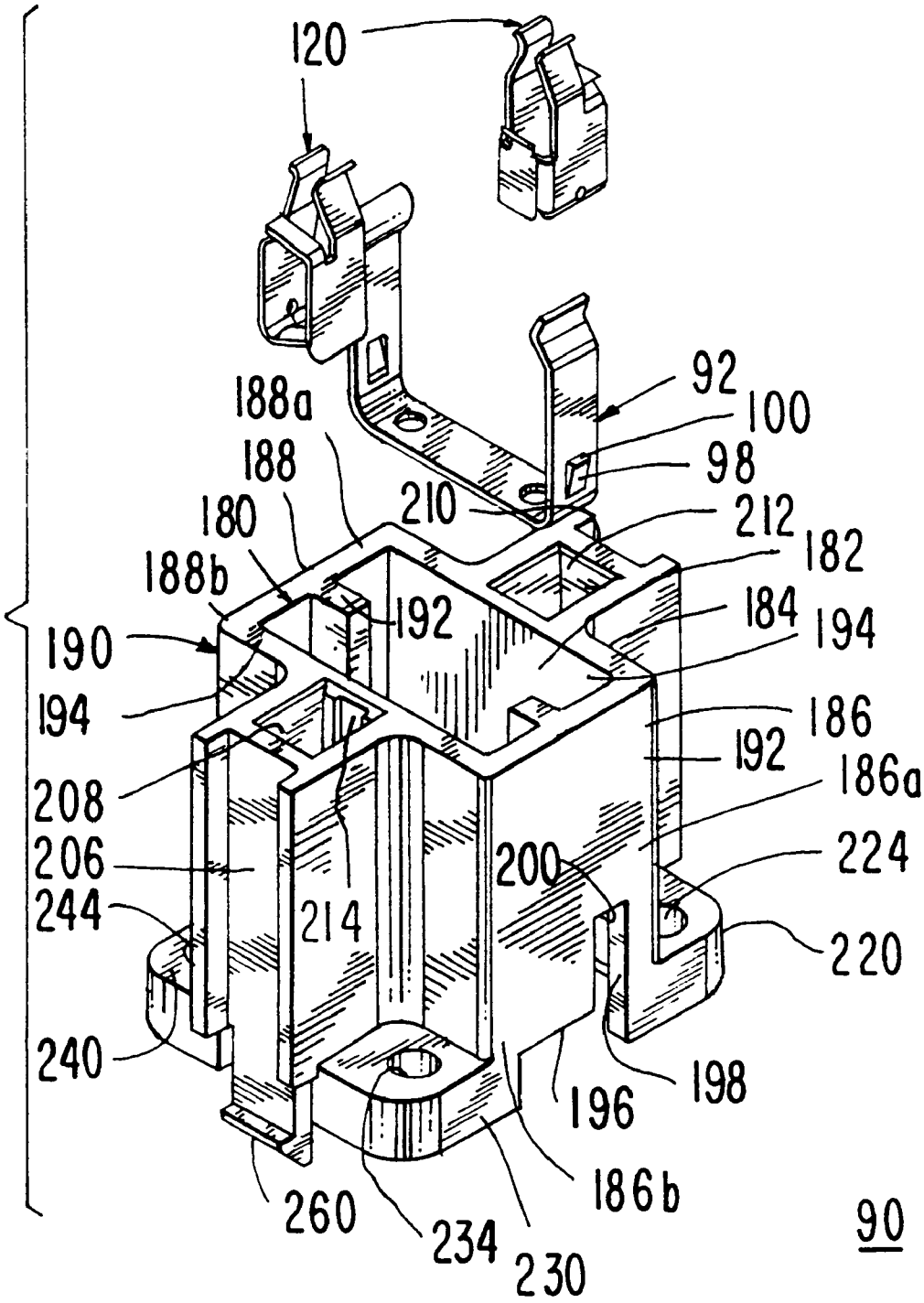
FIG. 6 is a perspective view, exploded, of a lampholder for compact fluorescent lamps, according to the concepts of the invention.
Figure 7:
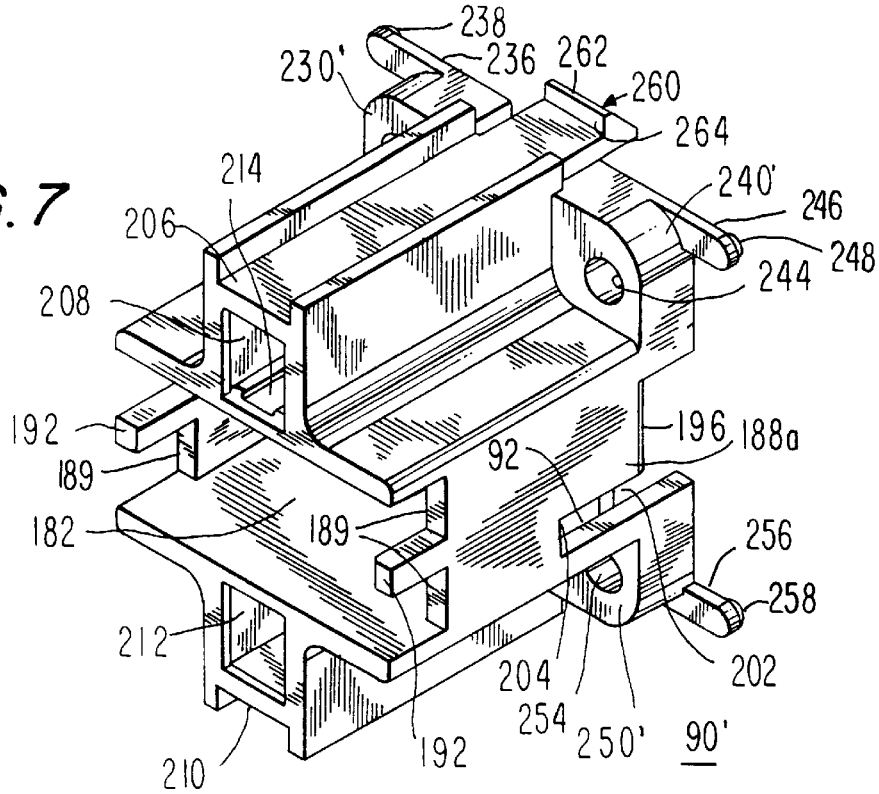
FIG. 7 is a front perspective view of a further embodiment of a lampholder for compact fluorescent lamps, according to the invention.

Turning now to FIGS. 6 to 11 the details of the housing 180 of lampholder 90 are described and shown. Housing 180 has a rectangular central cavity 182 having a top wall 184, a first side wall 186, a second side wall 188 and a bottom wall 190. Short, stub walls 192 may extend into central cavity 182 at the mid points of side walls 186 and 188 dividing them respectively into side walls 186*a*, 186*b* and 188*a*, 188*b*. The ends of stub walls 192 extend into the slots between the pairs of raised ribs 56 to portion 54 of lamp 40 to assist in positioning the lamp 40 in lampholder 90. The stub walls 192 also contain the snap clip 92 and prevent any lateral shift along the inner surfaces of walls 186 and 188. However, if desired, the stub walls 192 can be omitted as shown in the embodiment of FIG. 7. If desired, short slots 189 (as shown in FIG. 7) can be placed in the free ends of the walls 186*a*, 186*b*, 188*a* and 188*b* to assist in inserting snap clips 92. The cavity 182 extends generally from an open front surface 194 to a substantially closed rear surface 196. A slot 198 is formed in side wall 186*a* adjacent rear surface 196 and terminates in an end face 200 which joins a shelf 199 which extends into central cavity 182. The end face 200 and/or shelf 199 is engaged by the free end 100 of one of the two tabs 98 of snap clip 92. A second slot 202 is placed in side wall 188*a* adjacent rear surface 196 as shown in FIG. 7. End face 204 of slot 202 or shelf 203 which joins end face 204 and extends into central cavity 182 is engaged by the free end 100 of the second of the two tabs 98. The engagement of the free ends 100 of tabs 98 with end face 200 and/or shelf 199 and end face 204 and/or shelf 203 retains snap clip 92 in its intended position against the interior surface of end surface 196 and prevents unwanted removal of the snap clip 92.

A contact support 206, with a contact cavity 208 therein, extends outwardly from the exterior of bottom wall 190 and a similar support 210 with a contact cavity 212 therein, extends outwardly from top wall 184. Formed in the exterior of bottom wall 190, within contact support 206, is a recess 214 extending from front surface 194 towards rear surface 196 to receive tab 152 to guide the contact 120 into its final position after being inserted into contact support 206 from front surface 194. A similar recess 214 is placed in the exterior of top wall 184, within contact support 210. A slot, similar to slot 350 in FIG. 15 but not shown in FIGS. 6 to 11, extends upwardly from rear surface 196 towards front surface 184 within the recess 214 of contact support 206 but terminates short of front surface 194 to provide a surface, similar to surface 352, to be engaged by tab 152. Contact 120 is placed in contact support 206, from front surface 194, with tab 152 positioned in recess 214. The contact 120 is then pushed down towards rear surface 196 until tab 152 enters slot 350 and tab 152 moves below surface 352 which prevents removal of the contact 120 from contact support 206 by the engagement of tab 152 with stop surface 352 of slot 350.

A similar slot such as 350 with a stop surface 352 is placed in recess 214 of contact support 210. Once seated, the contact 120 inserted through front surface 194 into contact cavity 212 and advanced downwardly towards rear surface 196, any movement of a contact 120 towards front surface 194 is also prevented by engagement of tab 152 with stop surface 352.

Figure 8:
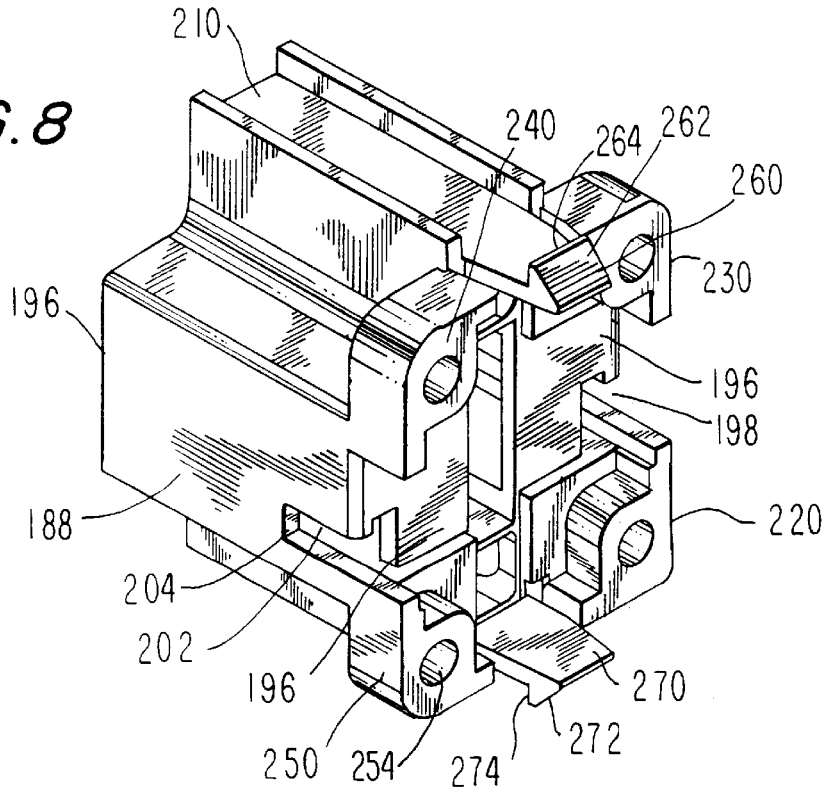
FIG. 8 is a rear perspective view of the lampholder of FIG. 6.

Mounting pads are placed at the four corners of lampholder 90. Pad 240 is mounted between bottom wall 190 and a wall of contact support 206 and has a thickness such that rear surface 196 sits above the panel to which it is mounted (See FIG. 1). The exposed corner of pad 240 is rounded and a bore 244 (see FIG. 9) extends through the pad 240 parallel with the walls 186, 188. The bottom surface of pad 240 is flat as shown in FIG. 8. In a similar fashion, pad 230 is mounted between bottom wall 190 and a second wall of contact support 206 and has a bore 234 therethrough. Pads 220 and 250 are each mounted between top wall 184 and a separate one of the walls of contact support 210 and have bores 224 and 254, respectively, therethrough. Fasteners (not shown) can be passed through two or more of the bores 224, 234, 244 and 254 to anchor lampholder 90 to a panel, such as mounting panel 28 of reflector 22 shown in FIG. 1.

Figure 10:
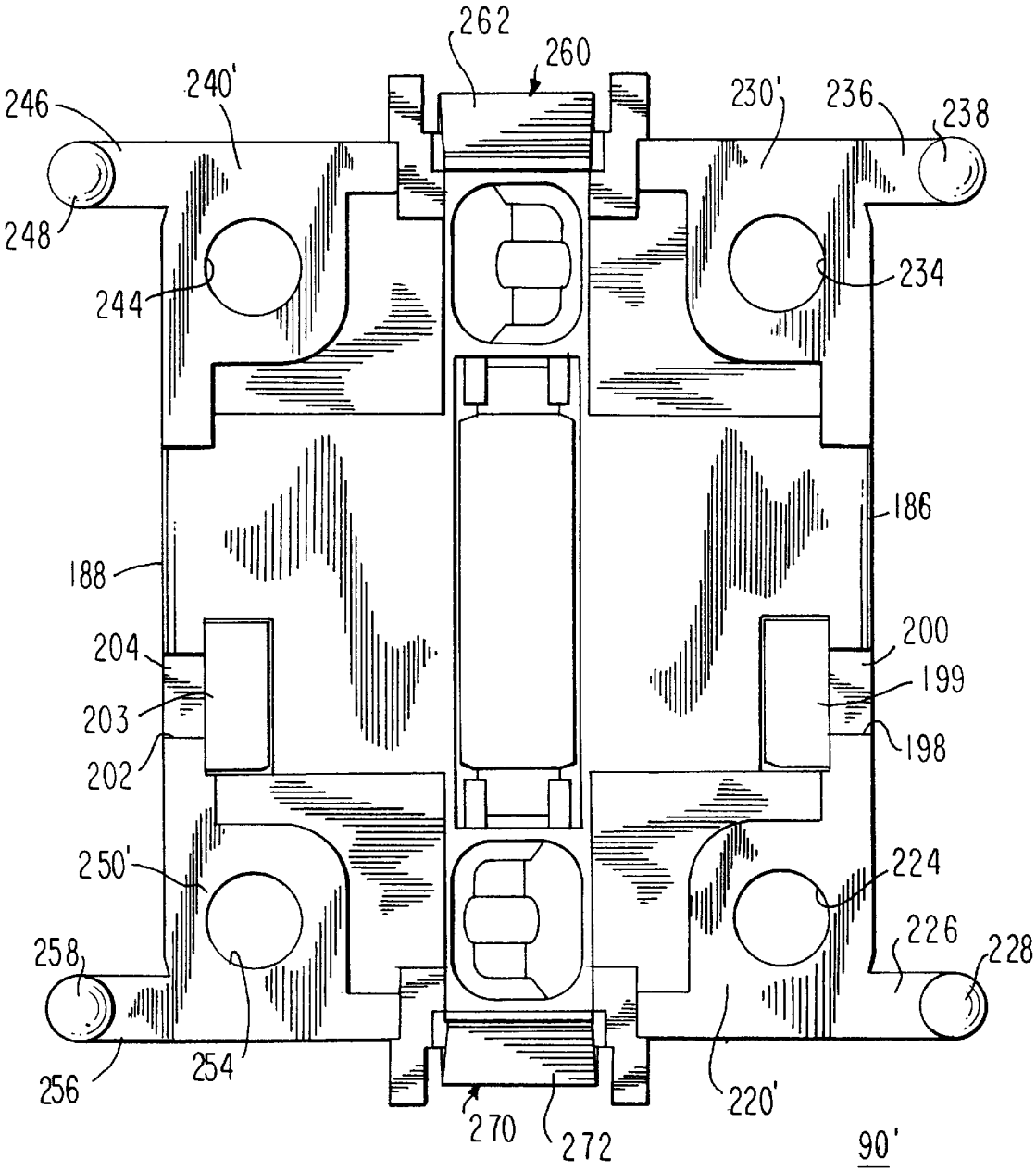
FIG. 10 is a rear plan view of the lampholder of FIG. 7.
Figure 11:
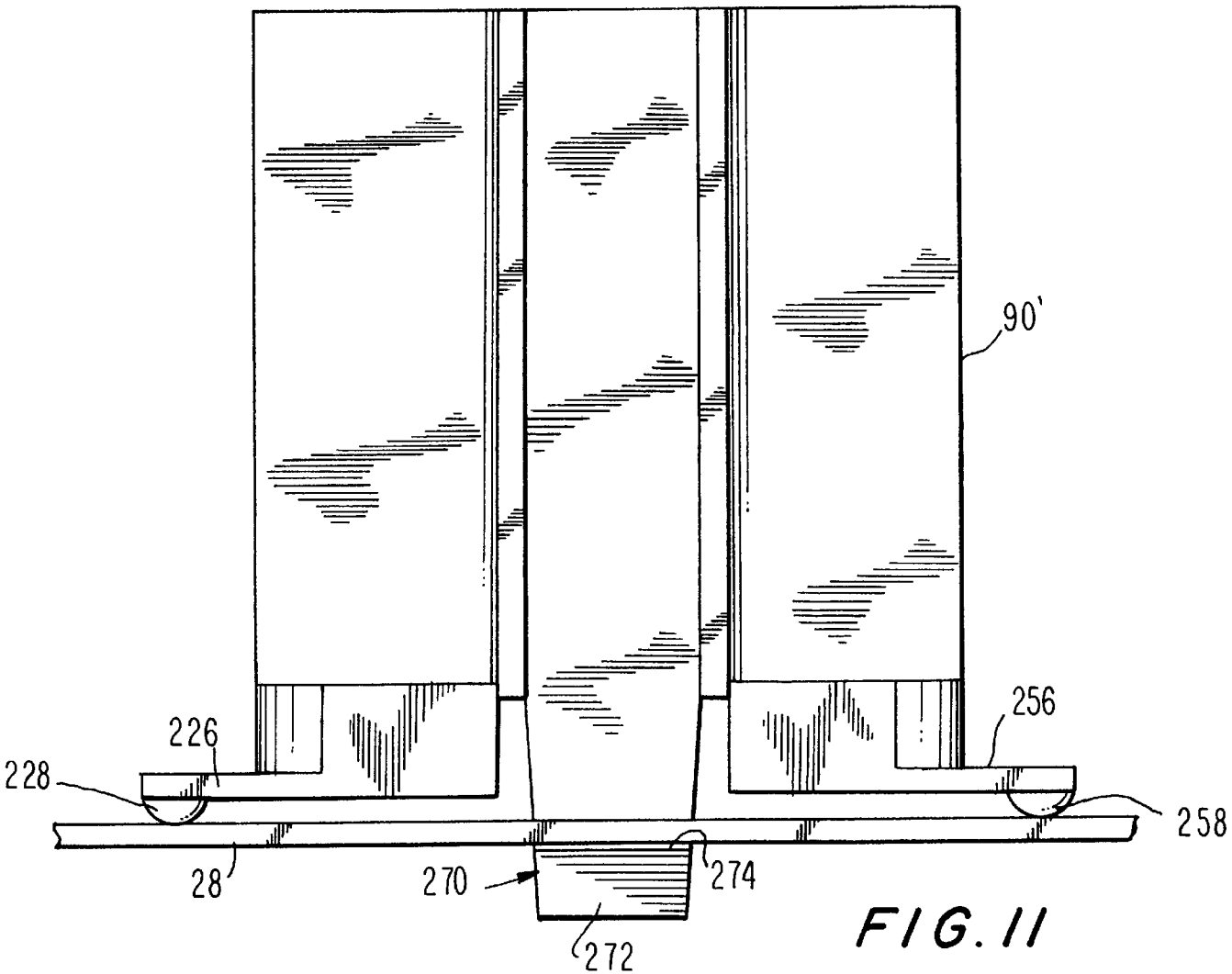
FIG. 11 is a side elevational view of the lampholder of FIG. 7 installed upon a mounting panel.

A modification can be made to the mounting pads of lampholder 90 to permit the lampholder 90 to be mounted upon panels of various thickness. As shown in FIGS. 7, 10 and 11 lampholder 90$^1$ has modified mounting pads which include a flexible arm whose bottom surface is generally an extension of the bottom surface of the remainder of the mounting pad. At the end of the flexible arm, on the underside thereof, is a hemispherically shaped protrusion. The top surface of the arm is generally flat and the cross-section of the arm is generally rectangular, although any of these aspects can be changed to improve or control the flexure of the flexible arms.

Mounting pad 240$^1$ has a flexible arm 246 and a hemispherically shaped protrusion 248 extending from the underside of said arm 246. Mounting pad 250$^1$ has a flexible arm 256 terminating on its underside at its free end in a hemispherically shaped protrusion 258. Similarly, pad 220$^1$ has an arm 226 and protrusion 228 while pad 230$^1$ has an arm 236 with protrusion 238. The flexible arms 226, 236, 246 and 256 will flex to different degrees depending upon the thickness of the mounting panel.

Flexible latching arms 260 and 270 extend from rear surface 196 and terminate below the mounting pads 220, 230, 240, and 250. The arm 260 is made more flexible by separating the arm 260 from adjacent mounting pads 230 and 240. Arm 270 is also separated from adjacent mounting pads 220 and 250.

Arm 270 has a sloped lead portion 272 which when it engages the edge of an aperture in a panel to which lampholder 90 is to be installed causes the entire arm 270 to flex inwardly until the horizontal surface 274 is adjacent the back surface of the panel at which time the arm 270 can return to its initial position and the panel 28 will be retained between horizontal surface 274 of arm 270 and the bottom surfaces of the mounting pads. In a similar fashion the inclined lead portion 262 causes the arm 260 to flex inwardly until horizontal surface 264 of arm 260 is below the rear face of the panel 28, and the panel will be retained between horizontal surface 264 of arm 260 and the bottom surfaces of the mounting pads. The flexible arms and their hemispherically shaped protrusions can take up any free space between the surface of the mounting panel and the lower surfaces of the mounting pads due to installation of the lampholder 90$^1$ upon a thinner panel than the lampholder 90$^1$ is intended to be used with or where different portions of the panel are of differing thickness. The flexible latching arms 260 and 270 would be placed in a mounting aperture with the horizontal surfaces 264 and 274 on the underside of the panel and the flexible arms and protrusions would act upon the top surface of the panel to cause the horizontal surfaces 264 and 274 to intimately engage the underside of the panel.

Figure 9:
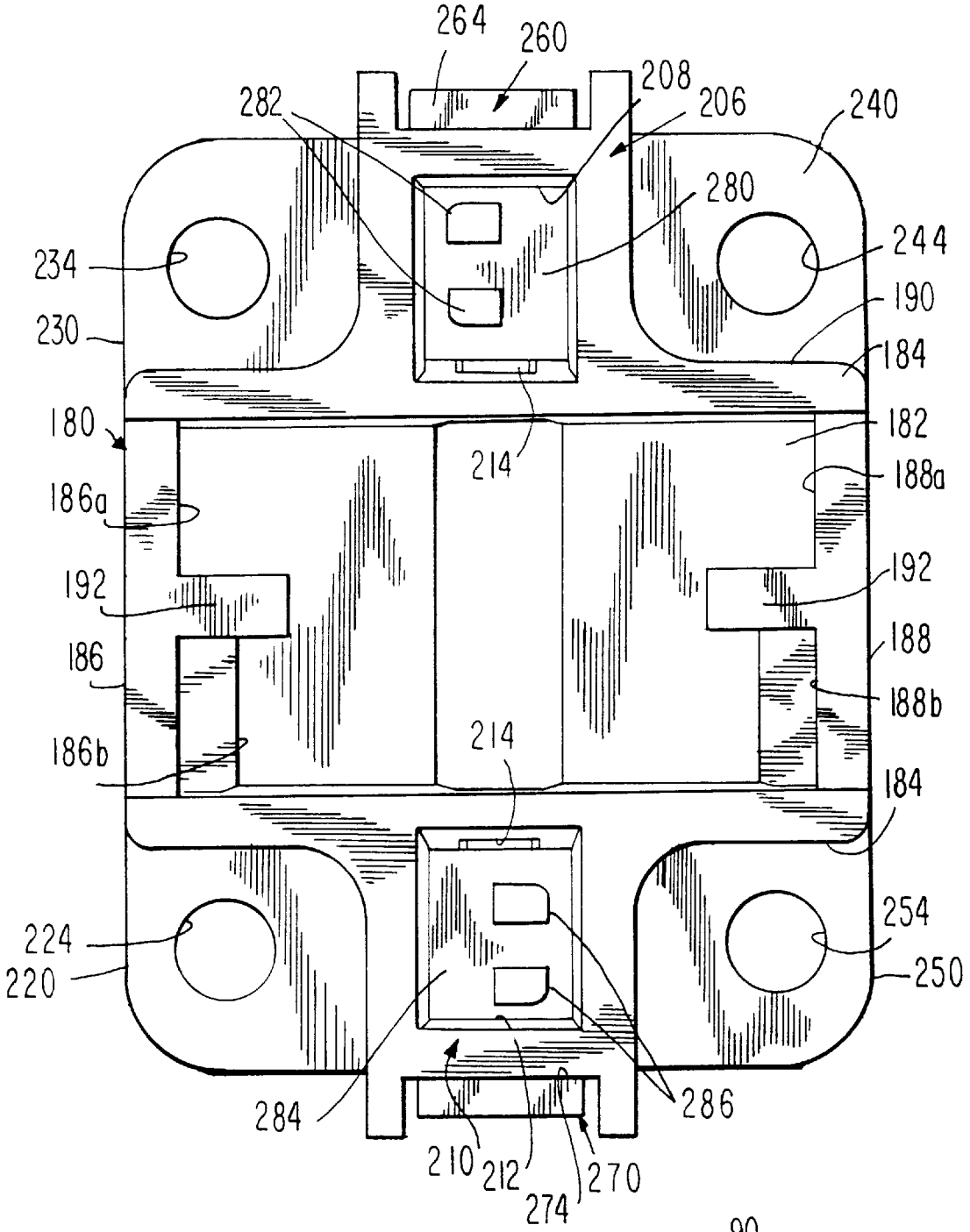
FIG. 9 is a top plan view of the lampholder of FIG. 6 with the snap clip and contacts removed to better appreciate the internal details of the housing.

Placed in contact cavity 208 between open front surface 194 and substantially closed rear surface 196 of housing 180, and generally parallel with rear surface 196, is a wall 280 in which are formed two apertures 282 (see FIGS. 9 and 10). The wall 280 is spaced inwardly from open front surface 194 sufficiently to permit the entire length of contact 120 to be accepted in contact cavity 208 and have ends 146 and 148 spaced from front surface 194 so that the contacts 120 when energized can not be touched inadvertently. The apertures 282 are so positioned in wall 280 that the space between the tabs 158, 160 and the base 128 is immediately accessible to the bare end of a conductor inserted through either of the apertures 282. In a similar fashion, a wall 284 is formed in contact cavity 212 and two apertures 286 extend through it to permit access to contact 120 placed in contact cavity 212 as above described.

Figure 15:
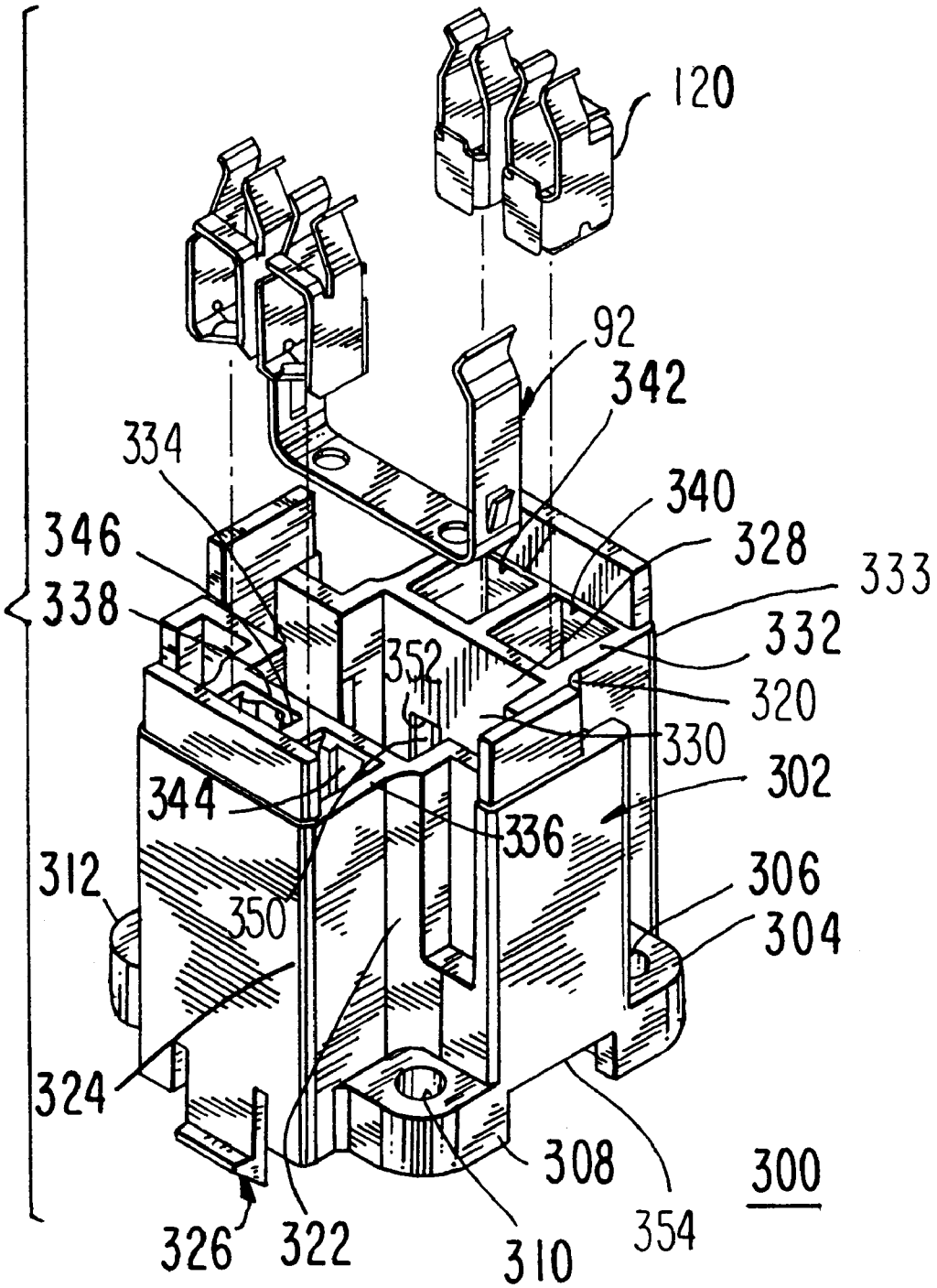
FIG. 15 is a perspective view, exploded, of a lampholder constructed in accordance with the concepts of the invention to accept quad-tube lamps.

Turning now to FIG. 15, there is shown a lampholder 300 for supporting and providing AC power to a quad tube 70 of the type shown in FIG. 5. The housing 302 of lampholder 300 has four mounting pads only three of which are shown in the figure, mounting pad 304 with aperture 306, mounting pad 308 with aperture 310 and mounting pad 312. Screws or bolts can be passed through two or more of these apertures to fasten the lampholder 300 to a mounting panel. Two flexible latching arms extend below the bottom surfaces of the mounting pads 304, 308, 312, only arm 326 is visible in the figure and are employed as described above with respect to arms 260, 270.

The rectangular central cavity 328 is the same size as the central cavity 182 of housing 180 of FIG. 6. A dual contact support 333, having contact cavities 340 and 342, is formed on the outer surface of top wall 320 and a second dual contact support 336, having contact cavities 344 and 346 is formed on the outer surface of bottom wall 322. A slot 350 extends on the interior of top wall 320 from the bottom surface 354 towards top surface 332 for about one half of the height of top wall 320 and aligned with contact cavity 342. The upper end of slot 350 provides a surface 352 to be engaged by the outwardly directed tab 152. A similar slot and surface is provided for each of the contact cavities 340, 344 and 346 to retain the contacts 120 in their associated contact cavities.

A recess 330 in one of the side walls between top wall 320 and bottom wall 322 and recess 334 in the opposite side wall made wide enough to accept the arms 96 of a snap clip 92. Shelves (not shown) similar to shelves 199 and 203 in FIG. 10 are placed across the recesses 330 and 334 and spaced from rear surface 354 to be engaged by free ends 100 of tabs 98 to retain the snap clip 92 in its desired position.

The lampholder 300 can be provided with flexible arms extending from each of the mounting pads 304, 308, 310, 312, each arm having a hemispherically shaped protrusion on its lower surface adjacent its free end in a fashion similar to that shown in FIGS. 7, 10 and 11.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. An electrical contact comprising:

a) a contact body having a first end and a second end;

b) said contact body made up of a top wall and a bottom wall partially joined to one another by a partial side wall and arranged to form a box with an open side wall;

c) said top wall at said first end having a first inwardly directed segment in a direction towards said bottom wall, followed by a first outwardly directed segments in a direction away from said bottom wall and a first curved segment between said first inwardly and first outwardly directed segments;

d) said bottom wall at said first end having a second inwardly directed element in a direction towards said top wall, followed by a second outwardly directed segment in a direction away from said top wall and a second curved segment between said second inwardly and second outwardly directed segments, said first and second curved segments separated by a distance to permit the entry and retention of an electrical contact therebetween; and e) a first cantilevered member extending from said bottom wall at said second end of said contact body, said cantilevered member bent inwardly towards an inside surface of said bottom wall and having a free end spaced apart from an inside surface of said top wall to engage the bared end of a conductor inserted between said free end and said inside surface of said top wall, said cantilevered member acting a an independent one-way clutch to prevent the removal of an inserted conductor.

2. An electrical contact as defined in claim 1, wherein said cantilevered member has a strengthening rib.

3. An electrical contact, as defined in claim 1, further comprising:

a) a locking tab extending from said partial sidewall of said contact body at an acute angle to said partial sidewall to engage a corresponding aperture in a side wall of a contact cavity into which said contact is placed and prevent the unwanted removal of said contact from said contact cavity.

4. An electrical contact, as defined in claim 1, further comprising:

a) a spacer extending from said top wall of said contact body at an acute angle to said top wall to permit the proper positioning in a contact cavity.

5. An electrical contact, as defined in claim 1, further comprising:

a) a second cantilevered member extending from said bottom wall at said second end of said contact body; said second cantilevered member bent inwardly towards said inside surface of said bottom wall and having a second free end spaced apart form an inside surface of said top wall to independently engage a bared end of a second conductor inserted between said second free end and said inside surface of said top wall, said cantilevered member and said second cantilevered member each acting as independent one-way clutches to prevent removal of said insulated conductor and said second insulated conductor inserted in said cantilevered and second cantilevered members, respectively.

6. An electrical contact as defined in claim 5, wherein each of said cantilevered members has a strengthening rib.

7. An electrical contact, as defined in claim 5, further comprising:

a) a locking tab extending from said partial sidewall of said contact body at an acute angle to said partial sidewall to engage of corresponding aperture in a side wall of a contact cavity into which said contact is placed and prevent the unwanted removal of said contact from said contact cavity.

8. An electrical contact, as defined in claim 5, further comprising:

a) a spacer extending from said top wall of said contact body at an acute angle to said top wall to permit proper positioning in a contact cavity.

* * * * *